United States Patent [19]

Burgin

[11] 4,443,892

[45] Apr. 24, 1984

[54] HELMET OR HAT AND SUPPORT MEANS

[75] Inventor: Ralph C. Burgin, West Point, Iowa

[73] Assignee: Dadant & Sons, Inc., Hamilton, Ill.

[21] Appl. No.: 363,620

[22] Filed: Mar. 30, 1982

[51] Int. Cl.[3] ..... A42B 3/00

[52] U.S. Cl. ..... 2/418; 2/181.4

[58] Field of Search ..... 2/418, 417, 419, 420, 2/197, 181.4, 183

[56] References Cited

U.S. PATENT DOCUMENTS 2,715,227 8/1955 Turner ..... 2/418 X 3,025,525 3/1962 Larson ..... 2/419

FOREIGN PATENT DOCUMENTS 227395 8/1959 Australia ..... 2/418

996612 9/1951 France ..... 2/419

328804 5/1930 United Kingdom ..... 2/417

*Primary Examiner*—Peter P. Nerbun

*Attorney, Agent, or Firm*—Fred Philpitt

[57] ABSTRACT

The present invention pertains to the combination of a hat, a hat band and support structure intermediate said hat and hat band.

5 Claims, 12 Drawing Figures

HELMET OR HAT AND SUPPORT MEANS

THE PRESENT INVENTION

Considered from one aspect the present invention pertains to a dome-shaped plastic hat which is adpated to be supported a spaced distance away from the head by a support structure that comprises:

(a) a first pair of hat band supports located on one portion of the lower interior side of the hat, said hat band supports having closely adjacent inner ends that are an integral part of the plastic hat at the time that it is formed and elongated sections that extend generally outwardly from said inner ends into the interior of the hat, but in a generally diverging relationship with respect to one another, each of said diverging elongated sections containing an elongated slot which extends over a substantial portion of its length, the end portions of said elongated slots which are closest to each other having a width which is enlarged in comparison with the remainder of the elongated slot so that this widened portion can accommodate a headband stud, (b) a second pair of hat band supports located on another portion of the lower interior side of the hat at a point spaced away from said first pair of hat band supports, said second pair of hat band supports having the same construction and arrangement as said first pair of hat band supports, and (c) a hat band in the form of a single strip of pliable plastic which is formed into a generally ring-like configuration with the end portions thereof in generally overlapping relationship, said hat band comprising (1) a first end portion that contains a plurality of spaced apart apertures (2) a second end portion that contains at least one upstanding projection which is adapted to engage one of said spaced apart apertures, depending upon the hat size of the wearer, and (3) an intermediate portion extending between said first and second end portions, said intermediate portion being provided (A) with a first pair of spaced apart outwardly extending studs that slideably engage said slots in said first pair of hat band supports and (B) with a second pair of spaced apart outwardly extending studs that slideably engage the slots in said second pair of hat band supports.

The invention will now be illustrated in the drawings by a preferred embodiment of the invention wherein.

Figure 1:
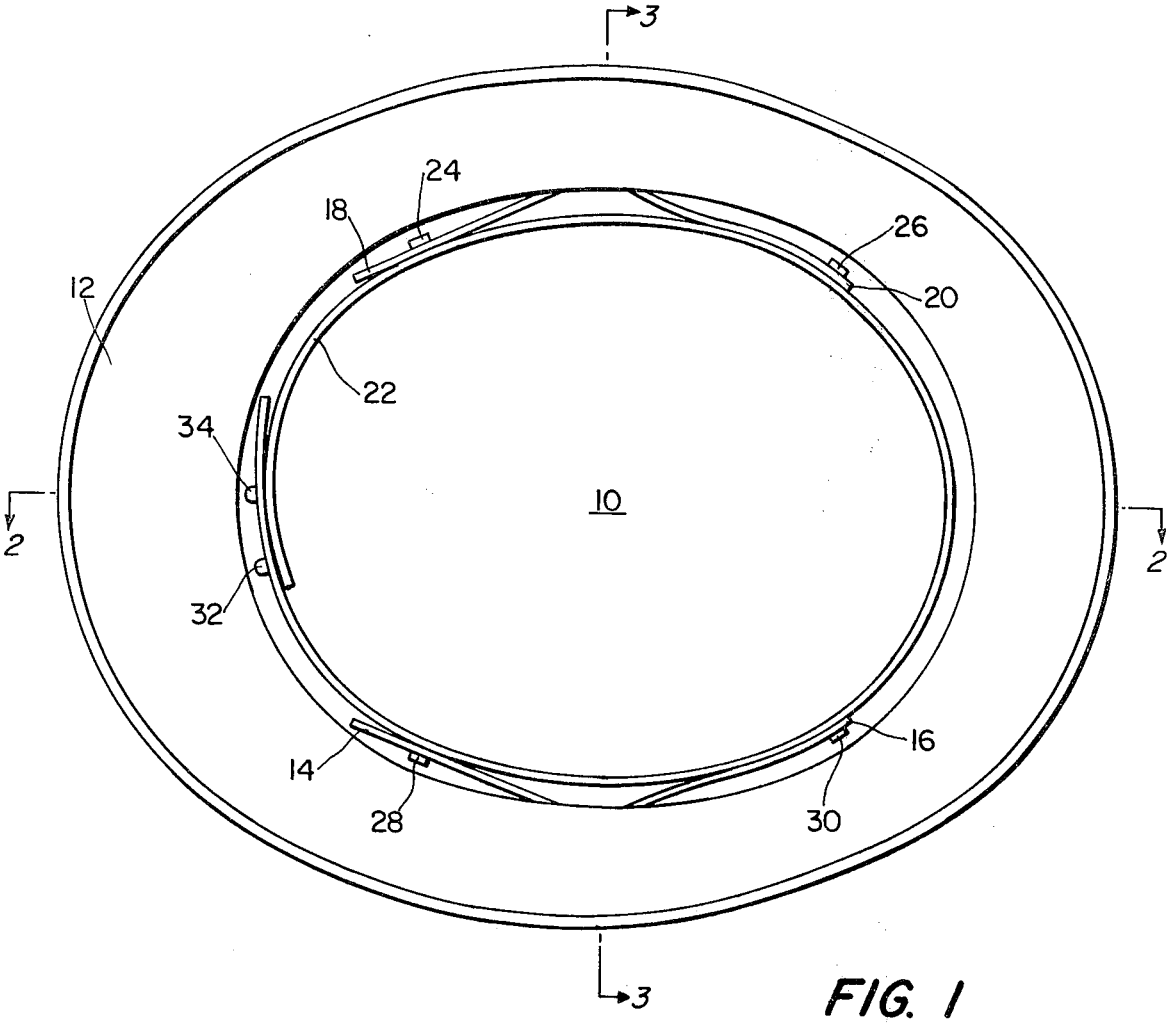
FIG. 1 is a bottom view of a hat and associated supporting means in accordance with this invention.
Figure 2:
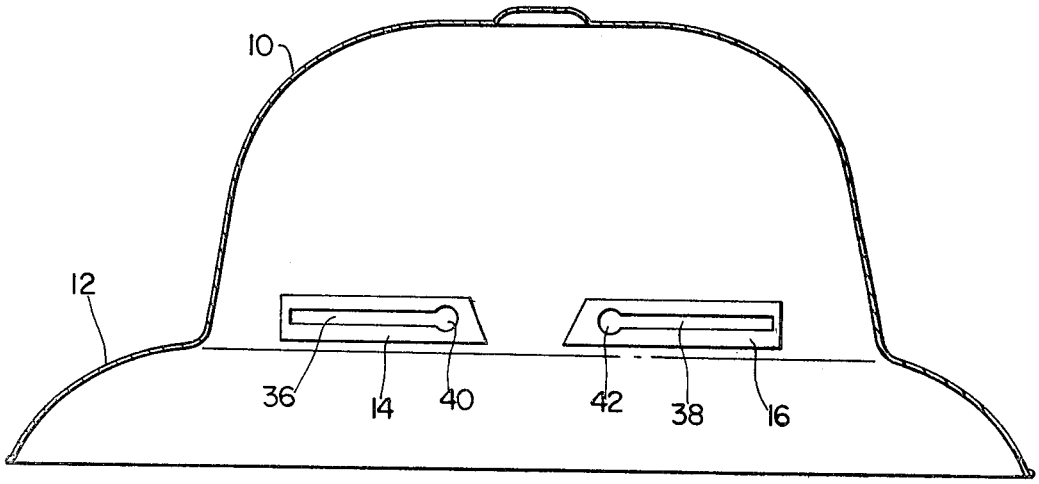
FIG. 2 is a sectional view along 2—2 of FIG. 1.
Figure 3:
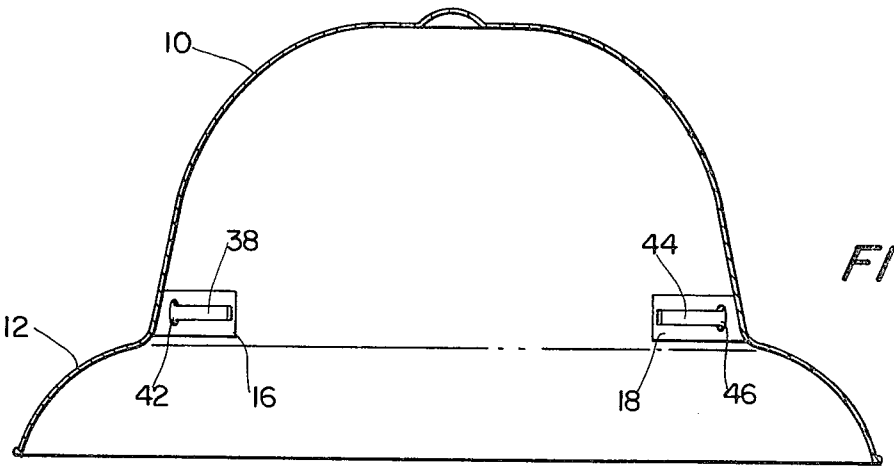
FIG. 3 is a sectional view along 3—3 of FIG. 1.
Figure 4:
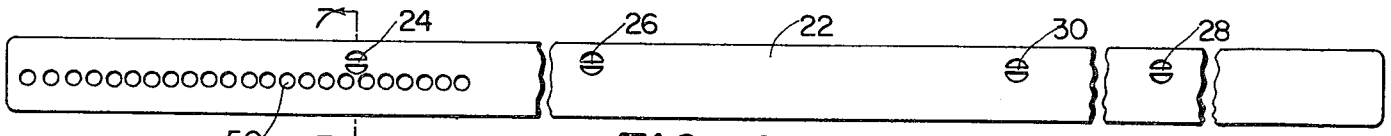
FIG. 4 is one side view of a hat band in accordance with this invention.
Figure 5:
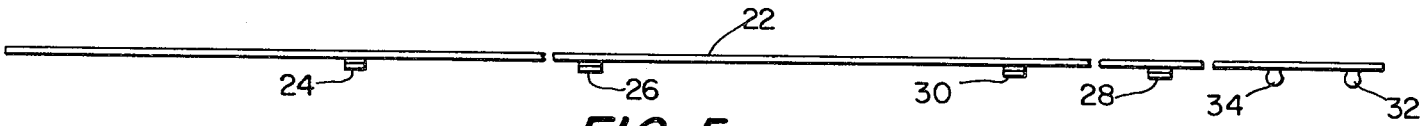
FIG. 5 is an edge view of the hat band of FIG. 4.
Figure 6:
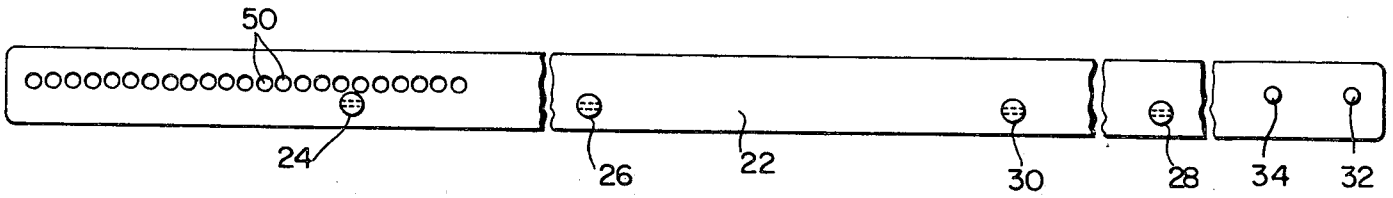
FIG. 6 is the other side view of the hat band of FIG. 4.
Figure 7:
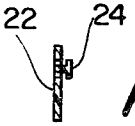
FIG. 7 is a sectional view along 7—7 of FIG. 4.

Referring now to the drawings, it will be seen that FIGS. 1–3 show a plastic hat or helmet composed of a dome-shaped portion 10 and a brim 12. A first pair of plastic hat band supports 14 and 16 are located on one portion of the lower interior side of the hat. The inner ends of the supports 14 and 16 (i.e. the ends that are closest together) are an integral part of the plastic dome-shaped portion 10 and are formed at the same time that the plastic hat is formed (preferably by injection molding). As can best be seen in FIG. 2 the hat band supports 14 and 16 comprise elongated sections that extend generally outwardly (from their inner points of attachment to the hat) into the interior head space of the hat so that they will be disposed generally tangentially to the head of the wearer of the hat. It will be noted that the hat band supports 14 and 16 diverge outwardly with respect to each other (at an angle greater than 90° and less than 180°). Each of the diverging elongated sections 14 and 16 contain elongated slots (36 and 38) which extend along a substantial portion of the length of each elongated section. The end portions of the elongated slots 36 and 38 which are closest to each other are enlarged (as at 40 and 42) in comparison with the remainder of each elongated slot so that these widened end portions can each accommodate the initial insertion of a stud (e.g. 28 and 30) located on the headband.

As FIGS. 1–3 show, a second pair of hat band supports 18 and 20 is located on the opposite lower interior side of the hat and supports 18 and 20 have the same construction and configuration as previously described supports 14 and 16. A side view of supports 18 and 20 would therefore correspond to what is shown in FIG. 2.

FIGS. 4–7 show a hat band 22 in the form of a single strip of plastic and FIG. 1 shows how this hat band is formed into a generally ring-like configuration with the end portions thereof in generally overlapping relationship. The hat band contains a first end portion that contains a plurality of spaced apart holes or apertures 50 and a second end portion that contains at least one projection and preferably several projections (32 and 34) which are adapted to engage one or several of said spaced apart apertures 50, depending upon the hat size of the wearer. The hat band 22 is preferably made of plastic that is somewhat pliable so that the head of each projection, which is preferably very slightly larger than the diameter of holes 50, can be forced through a hole 50 by gentle pressing to thereby secure the ends of the hatband together—and then manually pulled apart if the size of the headband needs to be changed.

FIGS. 8–12 show a second embodiment of a hat band in the form of a single strip of plastic and this hat band is designed to function in a hat in essentially the same way that has been described with respect to the hat band of FIGS. 4–7. The hat band contains a first end portion that contains a plurality of spaced apart holes or apertures **50*a* and a second end portion that contains at least one projection and preferably several projections (32*a* and 34*a*) which are adapted to engage one or several of said spaced apart apertures 50*a*, depending upon the hat size of the wearer. The hat band 22*a* is preferably made of plastic that is somewhat pliable so that the head of each projection, which is preferably very slightly larger than the diameter of holes 50*a*, can be forced through a hole 50*a*** by gentle pressing to thereby secure the ends of the hat band together—and then manually pulled apart if the size of the headband needs to be changed.

The intermediate portion of the hat band that extends between the aforesaid end portions is provided with a first pair of spaced apart outwardly extending studs 28 and 30 that are adapted to slideably engage the elongated slots 36 and 38 and a second pair of spaced apart outwardly extending studs 24 and 26 that are adapted to slideably engage elongated slots in supports 18 and 20 that correspond to slots 36 and 38. The maximum dimension or diameter of the studs 24–30 is greater than the width of the slots (e.g. 36 and 38) in the hat band supports 14–20 so that once the studs are inserted thru the enlarged portions (e.g. 40 and 42) of those slots and then moved into the narrower portion of the elongated slots, the studs will not become disengaged from the hat band supports. In a preferred embodiment each pair of studs (e.g. 28 and 30) will be spaced apart far enough from each other so that once they are placed in the elongated slots (e.g. 36 and 38) they cannot be removed from or accidentally worked out of the elongated slots without deforming the hatband inwardly from the position shown in FIG. 1. This means that the headband cannot come loose from the hat in normal use or while being worn.

The hat band of FIGS. 8–12 differs from that of FIGS. 4–7 in that the hat band of FIGS. 8–12 includes at least one array of guides and stops to facilitate secure engagement of the hat band 22*a* with the supports 14, 16, 18 and 20. In the embodiment shown a pair of guides 40 are provided on opposite sides of each of the studs 24*a*, 26*a*, 28*a* and 30*a* and at a spaced distance therefrom. The distance between each pair of guides 40 (i.e. the distance "d" in FIG. 11) should be about the same as the width of the supports 14, 16, 18 and 20 so that these supports will be restrained from moving or twisting with respect to the hat band once they are positioned between guides 40.

Figure 8:
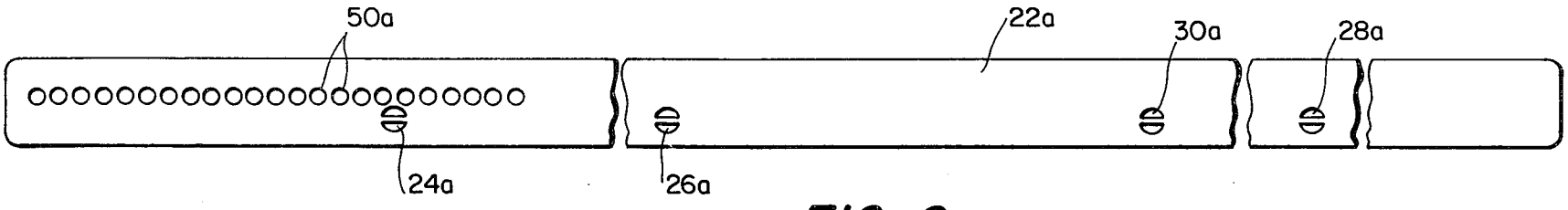
FIG. 8 shows one side view of a second embodiment of a hat band in accordance with this invention.
Figure 9:
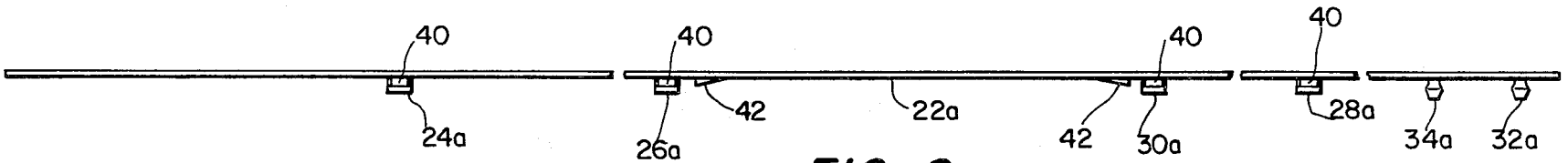
FIG. 9 is an edge view of the hat band of FIG. 8.
Figure 10:
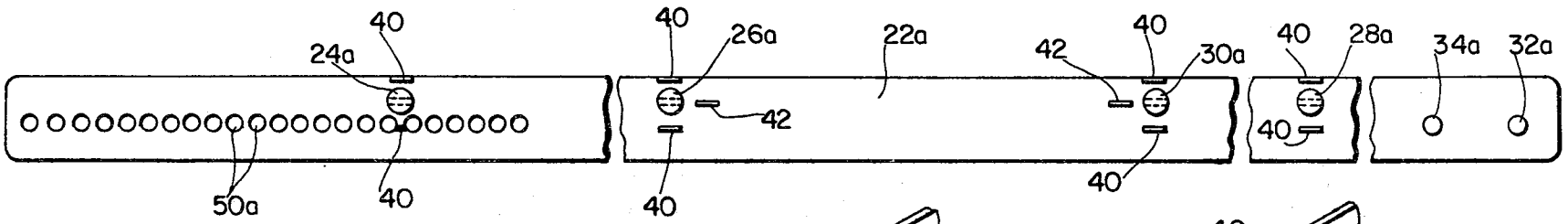
FIG. 10 is the other side view of the hat band of FIG. 8.
Figure 11:
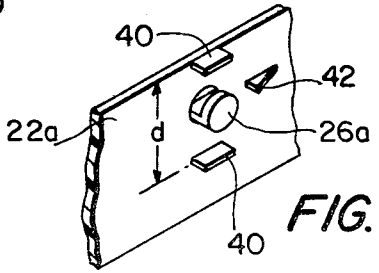
FIG. 11 is a fragmentary perspective view of the hat band shown in FIGS. 8–10.
Figure 12:
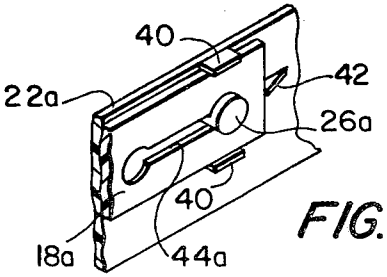
FIG. 12 is a fragmentary perspective view similar to FIG. 11 and which shows how a hat band and a hat band support engage each other.

FIGS. 8–12 also show stop members 42 that serve to partially limit the circumferential movement of the hat band and hat band support relative to each other. As shown in FIGS. 8–10 two such stop members 42 are provided adjacent the two inner studs 26*a* and 30*a* and the manner in which these stop members 42 abut against the end of a hat band support 18*a* is best illustrated in FIG. 12. When such a hat band is in place in a hat (such as is shown in FIG. 1) the stop members 42 would engage the outer free ends of the supports 16 and 20. The stops will thus prevent the hat band from sliding backwards or rotating relative to the supports 16 and 20 and accordingly serve to keep the hat band much tighter on the head. The guides 40 also serve to stabilize the hat, especially when they work in conjunction with the stops 42.

Since the hat bands in FIGS. 8–10 are broken into segments because of space limitations on the drawing sheet, it might be helpful to note that in a preferred embodiment the hat band is characterized by the following dimensions and distances (in inches):

| | |
|---|---|
| total length | 25.7 |
| width | 1 |
| left end to 24a | 4.5 |
| 24a to 26a | 5.5 |
| 26a to 30a | 6.0 |
| 30a to 28a | 5.5 |
| 28a to right end | 4.5 |

-continued

| | |
|---|---|
| 28a to 34a | 1.0 |
| 34a to 32a | 1.0 |
| "d" | $\frac{5}{8}$ |
| diameter of 26a | .25 |

In conclusion, while the foregoing specification and drawing describe the construction, operation and use of some preferred embodiments of the instant invention, it is to be understood that I do not intend to limit myself to the precise constructions and arrangements herein disclosed, since the various details of construction, form and arrangement may obviously be varied to a considerable extent by anyone skilled in the art without really departing from the basic principles and novel teachings of this invention and without sacrificing any of the advantages of the invention, and accordingly, it is intended to encompass all changes, variations, modifications and equivalents falling within the scope of the appended claims.

What is claimed is:

1. A dome-shaped plastic hat which is adapted to be supported a spaced distance away from the heat by a support structure that comprises:

(a) a first pair of hat band supports located on one portion of the lower interior side of the hat, said hat band supports having closely adjacent inner ends that are formed as an integral part of the plastic hat and elongated sections that extend generally outwardly from said inner ends into the interior of the hat in a generally diverging relationship with respect to one another, each of said diverging elongated sections containing an elongated slot which extends over a substantial portion of its length, (b) a second pair of hat band supports located on an opposite portion of the lower interior side of the hat at a point spaced away from said first pair of hat band supports, said second pair of hat band supports having the same construction and arrangement as said first pair of hat band supports, and (c) a hat band in the form of a single strip of pliable plastic which is formed into a generally ring-like configuration with the end portions thereof in generally overlapping relationship, said hat band comprising (1) a first end portion that contains a plurality of spaced apart apertures, (2) a second end portion that contains at least one upstanding projection which is adapted to engage one of said spaced apart apertures depending upon the hat size of the wearer, and (3) an intermediate portion extending between said first and second end portions, said intermediate portion being provided with four aligned spaced apart outwardly extending studs that slideably engage in respective elongated slots in said first and second pairs of hat band supports, the inner two studs having positioned between them two stop members adapted for limiting the movement of the hat band relative to the outwardly extending free end of one hat band support located on one side of the hat and the outwardly extending free end of a hat band support located on the opposite side of the hat.

2. A hat according to claim 1 wherein the end portions of the elongated slots which are adjacent the inner ends of said supports have a width which is enlarged in comparison with the remainder to the elongated slot so that these widened portions can each accommodate a head band stud.

3. A hat according to claim 1 wherein said two outer studs are spaced apart a great enough distance so that they can slide back and forth in their respective elongated slots but cannot come into alignment with either of said widened portions unless the hat band is deformed out of its elliptical configuration.

4. A hat according to claim 1 wherein the hat band is provided with spaced apart guide means which are positioned to slideably engage the upper and lower edge portions of said hat band supports.

5. A hat according to claim 4 wherein said guide means are in pairs and each pair is located on opposite sides of a stud.

* * * * *